United States Patent [19]

Matsumoto et al.

[11] Patent Number: 4,921,166

[45] Date of Patent: May 1, 1990

[54] HOT WATER CIRCULATING SYSTEM

[75] Inventors: Motoki Matsumoto; Kouichi Watanabe, both of Aichi, Japan

[73] Assignee: Toyotomi Kogyo Co., Ltd., Japan

[21] Appl. No.: 226,094

[22] Filed: Jul. 29, 1988

[30] Foreign Application Priority Data

Jul. 31, 1987 [JP] Japan ..... 62-192811

[51] Int. Cl.[5] ..... F24D 3/00

[52] U.S. Cl. ..... 237/60; 237/59

[58] Field of Search ..... 237/60, 59, 64, 66, 237/19, 6, 67; 122/33, 40

[56] References Cited

U.S. PATENT DOCUMENTS 2,170,225 8/1939 Unge ..... 237/60

2,738,928 3/1956 Liekerman ..... 237/60

FOREIGN PATENT DOCUMENTS 53929 1/1982 Japan .

*Primary Examiner*—Henry A. Bennet

*Assistant Examiner*—John Sollecito

*Attorney, Agent, or Firm*—Pollock, Vande Sande & Priddy

[57] ABSTRACT

A hot water circulating system capable of decreasing energy loss, increasing the amount of hot water to be circulated per unit time and reducing time required for each circulating cycle. The system includes a valve opened at the start of emptying of water out of a water boiler to supply water from an open tank to the water boiler. The water boiler is divided into a heated section and a hot water receiving section arranged above and communicated with the heated section.

13 Claims, 2 Drawing Sheets

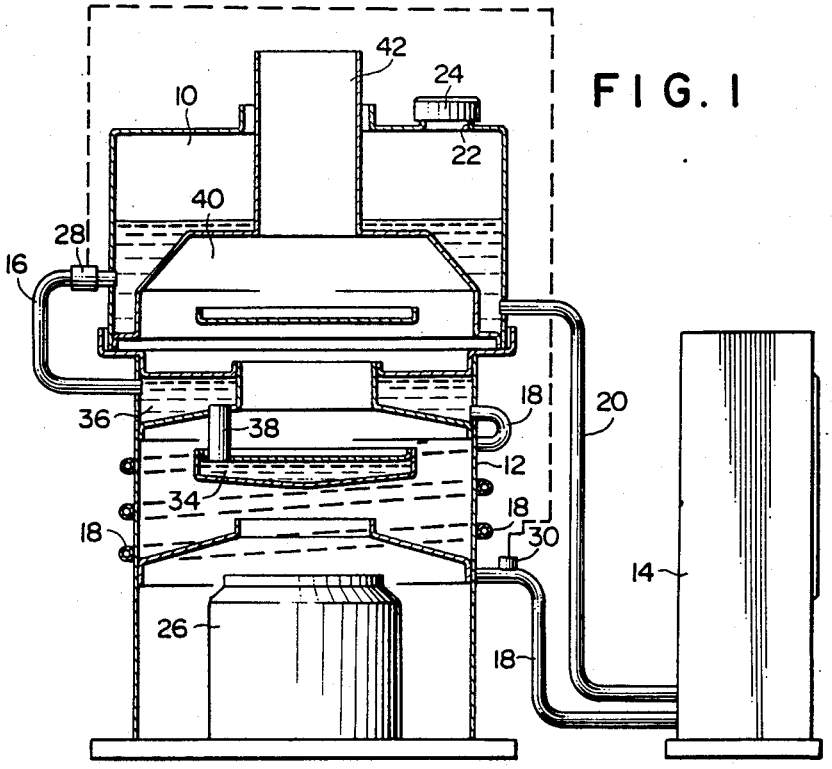
FIG. 1
FIG. 2
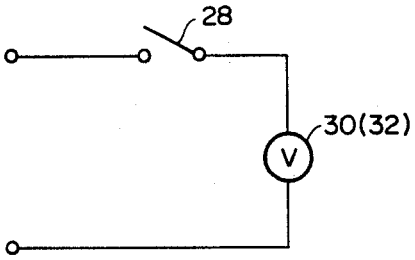
FIG. 3
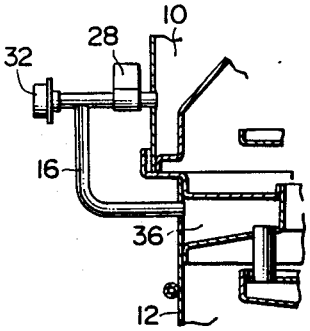

HOT WATER CIRCULATING SYSTEM

BACKGROUND OF THE INVENTION

1. Field of the Invention

This invention relates to a hot water circulating system, and more particularly to a hot water circulating system for, for example, space heating which is adapted to supply hot water to a radiator by means of steam pressure without using a circulation pump.

2. Description of the Prior Art

A hot water circulating system which is adapted to carry out circulation of hot water heated in a water boiler to a radiator by steam pressure without using a circulation pump has been conventionally put in practice, as disclosed in Japanese Utility Model Publication No. 53929/1982, disclosure of which is incorporated herein by reference.

Such a conventional hot water circulating system is constructed in such a manner that steam pressure generated from a closed water boiler heated by a burner causes hot water in the water boiler to be forcibly fed through a radiator to an open tank arranged at a position above the water boiler, and water stored in the open tank is returned through an on-off valve to the water boiler.

In the conventional hot water circulating system constructed as described above, a structure for returning water in the open tank to the water boiler is the key to stable operation of the system. In general, a liquid level detector generates a signal for opening the valve while water remains in the water boiler, because when water is introduced from the open tank into the water boiler after hot water is fully emptied out of the water boiler, it is instantaneously vaporized to increase pressure in the water boiler to a level sufficient to prevent flowing of water from the open tank into the water boiler.

Unfortunately, when the valve is opened while water remains in the water boiler, a large amount of water vapor is discharged from the water boiler being heated through the valve to an ambient atmosphere, resulting in significant energy loss. Also, this leads to loss of water to be circulated and an increase in time required for each circulation cycle.

Thus, the conventional hot water circulating system results in the amount of water to be circulated in each circulating cycle being substantially reduced.

Accordingly, it would be highly desirable to develop a hot water circulating system which is capable of decreasing energy loss, preventing a decrease in hot water to be circulated and reducing time required for each circulating cycle.

SUMMARY OF THE INVENTION

Generally speaking, in accordance with the present invention, a hot water circulating system is provided. The system includes an open tank, a water boiler arranged below the open tank and communicating with the open tank through a first connection pipe, heating means for heating the water boiler and a radiator communicating with the water boiler through a second connection pipe. Also, the system includes emptiness detecting means for detecting the absence of liquid water in the water boiler and a valve arranged on the first connection pipe and associated with the emptiness detecting means so as to be opened to supply water from the open tank through the first connection pipe to the water boiler when the emptiness detecting means detects an empty boiler. The water boiler comprises a heated section heated by the heating means and a hot water receiving section arranged above and communicated with the heated section. The water boiler is in communication at the hot water receiving section with the open tank and radiator through the first and second connection pipes, respectively. The heated section and hot water receiving section of the water boiler are arranged so as to cause pressure of water vapor produced in the heated section to forcibly supply hot water in the hot water receiving section to the radiator.

Accordingly, it is an object of the present invention to provide a hot water circulating system which is capable of effectively preventing a decrease in the amount of water to be circulated in each circulating cycle.

It is another object of the present invention to provide a hot water circulating system which is capable of substantially decreasing energy loss.

It is a further object of the present invention to provide a hot water circulating system which is capable of reducing time required for each circulating cycle.

It is still another object of the present invention to provide a hot water circulating system which is capable of significantly improving heat efficiency.

It is still a further object of the present invention to provide a hot water circulating system which is capable of being manufactured at a low cost.

It is yet a further object of the present invention to provide a hot water circulating system which is capable of providing comfortable heating.

It is an even further object of the present invention to provide a hot water circulating system which is capable of accomplishing the above-described objects with a simple structure.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout; wherein:

FIG. 1 is a vertical sectional view showing an embodiment of a hot water circulating system according to the present invention;

FIG. 2 is a circuit diagram showing electrical connection between an emptiness detecting switch and a valve in the embodiment shown in FIG. 1; and FIG. 3 is a fragmentary vertical sectional view showing an essential part of a modification of the hot water circulating system shown in FIG. 1.

DETAILED DESCRIPTION OF THE PREFERRED EMBODIMENTS

Figure 4:
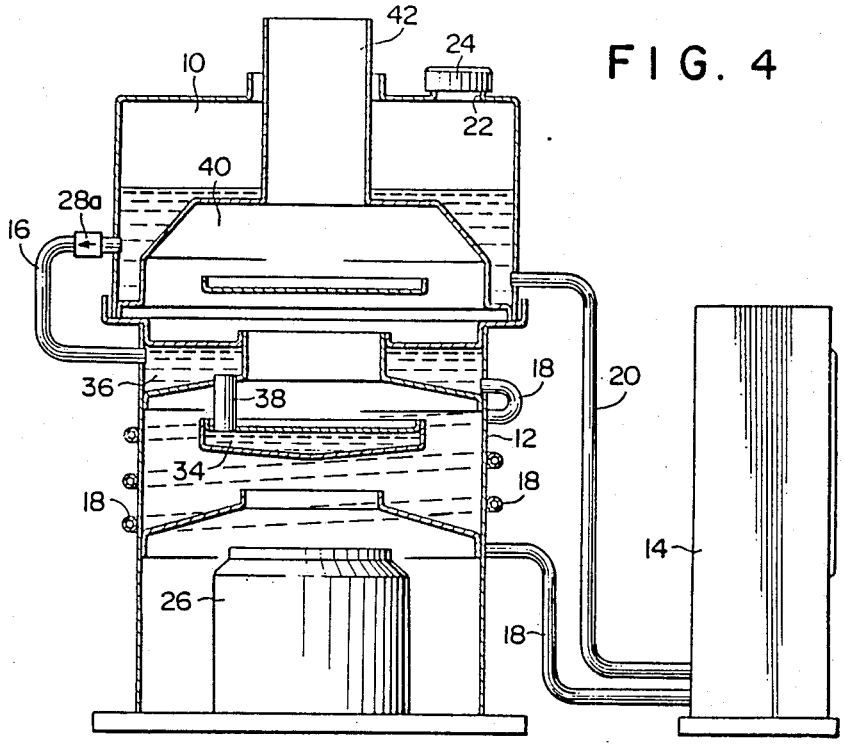
FIG. 4 is a vertical sectional view showing a modification of the valve arrangement in FIG. 1.

Now, a hot water circulating system according to the present invention will be described hereinafter with reference to the accompanying drawings.

FIG. 1 illustrates an embodiment of a hot water circulating system according to the present invention. A hot water circulating system of the illustrated embodiment is adapted to open a valve when hot water emptied from a water boiler. The configuration or structure of the water boiler ensures positive circulation of hot water and reduces the time required for each cycle.

For this purpose, the hot water circulating system of the illustrated embodiment generally includes an open tank 10, a water boiler 12 arranged below the open tank 10, and a radiator 14 to which hot water obtained in the water boiler 12 is supplied. Between the open tank 10 and the water boiler 12 is arranged a first connection pipe 16 to communicate with each other. Also, a second connection pipe 18 is provided for communication between the water boiler 12 and the radiator 14. To an outlet of the radiator 14 is connected an outflow pipe 20. In the illustrated embodiment, the outflow pipe 20 is connected to the open tank 10, resulting in the open tank 10, water boiler 12, radiator 14 and the pipes 16, 18 and 20 forming a substantially closed circulation system. Thus, the outflow pipe 20 acts as a third connection pipe.

However, the present invention is not limited to such construction. The outflow pipe 20 may be connected to any suitable means such as a hot water supply tank. In this instance, the open tank 10 is provided with any suitable water supply means through which water is supplied to the open tank. For example, the open tank 10 is provided with a water supply port 22 normally closed with a cap 24, through which water is supplied from an external water source to the open tank 10. Alternatively, an external water supply pipe may be connected directly to the open tank 10.

The water boiler 12 is heated by suitable heating means 26 such as a burner which is arranged below the water boiler 12. The connection pipe 16 is provided with a valve 28 which acts to selectively communicate the water boiler 12 with the open tank 10. In the illustrated embodiment, the valve 28 may comprise an on-off valve.

An empty water boiler 12 may be detected by monitoring a variation in temperature of the water boiler 12 or pressure therein. For this purpose, the system includes emptiness detecting means. In the illustrated embodiment, the emptiness detecting means may comprise a temperature switch 30 arranged on the second connection pipe 18 so as to monitor the temperature of fluid flowing through the second connection pipe 18, to thereby detect the presence of vapor instead of liquid water. The temperature switch 30 detects a variation in temperature occurring when the fluid changes from liquid to vapor at the time the boiler becomes substantially empty of liquid water. A liquid temperature of water substantially free of chemicals is normally about 100° C. or below, whereas its vapor temperature is normally above 100° C. When the boiler starts to be empty, the water boiler 12 and pipe 18 are substantially occupied by only water vapor or steam because the water boiler is substantially emptied of liquid water. In order to open the valve 28 to introduce water from the open tank 10 to the water boiler 12 through the connection pipe 16 when the switch 30 detects an empty boiler or changes over at the start, the switch 30 may be electrically connected to the valve 28 in a manner as shown in FIG. 2. When the water boiler 12 is cooled by the so-introduced water, the temperature of the connection pipe 18 is lowered to lead to changing-over of the switch 30 which closes valve 28.

Operation of the valve 28 may be carried out by detecting a variation in pressure in water boiler 12, wherein the emptiness detecting means comprises a pressure switch. In this instance, the illustrated embodiment may be constructed in such a manner as shown in FIG. 3. The pressure switch designated by reference numeral 32 in FIG. 3 is mounted on a portion of the first connection pipe 16 between the water boiler 12 and the valve 28 to detect a variation in pressure in the water boiler 12 occurring when the water boiler is first empty or to change over when the boiler is empty. The pressure switch 32 may be connected to the on-off valve 28 in the manner shown in FIG. 2. When water has been emptied from the water boiler 12, water vapor is not generated therein, so that pressure in the water boiler 12 approaches atmospheric pressure. Such reduction of pressure is detected by the pressure switch 32, which causes the valve 28 to be opened. This results in water in the open tank 10 being supplied through the first connection pipe 16 to the water boiler 12 by head. At this time, the water boiler 12 is not yet superheated, so that introduction of water to the water boiler 12 causes it to be immediately cooled and water vapor remaining therein to be cooled into liquid. This results in pressure in the water boiler being negative to ensure successive supply of water from the open tank 10 to the water boiler 12.

In the illustrated embodiment, the emptiness detecting means may comprise a check valve **28*a* as shown in FIG. 4. Check valve 28A may be constructed so as to act as both a pressure switch and an on-off valve. Accordingly, when such a check valve is used as the emptiness detecting means, the pressure switch 32 or temperature switch 30** can be eliminated.

In the present invention, the water boiler 12 includes a heated section 34 heated by the burner 26 and a hot water receiving section 36 arranged above the heated section 34 and communicating therewith through a pipe 38. The first and second connection pipes 16 and 18 are connected to the hot water receiving section 36.

In the open tank 10 is defined a space 40 which communicates with the burner 26 through the water boiler 12 so as to serve as a chamber for temporarily storing combustion gas produced by the burner 26. The chamber 40 further communicates through an exhaust passage 8 to an ambient atmosphere. Combustion gas formed by combustion at the burner 26 temporarily stays in the combustion gas chamber 40 and is discharged through the exhaust passage 42, during which time the open tank 10 is heated by heat of the combustion gas. Thus, it will be noted that the combustion gas chamber 40 serves as a heat exchanger.

Now, the manner of operation of the hot water circulating system of the illustrated embodiment will be described.

First, prior to operation of the system, the on-off valve 28 is kept open and water is supplied to the open tank through the water supply port 22. This results in water flowing through the pipe 16 and valve 28 to the water boiler 12 and then through the pipe 18 to the radiator 14. Supply of water to the open tank 10 is stopped when water is stored in a small amount therein.

Subsequently, the valve 28 is closed. When the pressure switch 32 is used instead of the temperature switch 30 or the above-described check valve is used as the valve 28, the valve 28 is automatically closed with an increase in pressure in the water boiler 12. Then, the burner 26 is ignited to heat the water boiler 12. This causes a part of water in the boiler to be heated to produce water vapor or steam, which increases pressure in the water boiler 12, resulting in water in the boiler 26 being forcedly fed to the radiator 14. The radiator cools the hot water, which is then returned to the open tank 10.

When pressure of water vapor produced in the water boiler 12 causes substantially all hot water to be supplied to the radiator 14 and then to the open tank 10 to lead to emptying of water out of the water boiler 12, the temperature switch 30 detects start of the emptiness to open the valve 28. In the construction shown in FIG. 3, when the emptiness starts, production of water vapor is substantially decreased to reduce pressure in the water boiler 12 to atmospheric pressure. The pressure switch 32 detects such reduction of pressure to open the valve 28. This results in water being introduced from the open tank 10 through the connection pipe 16 to the water boiler 12. At this time, the steam in water boiler 12 is not yet superheated because until this time liquid water has also been present. Accordingly the introduced water cools the water boiler 12 and water vapor possibly remaining in the water boiler to lead to condensation of the vapor, so that pressure in the water boiler 12 is negative. This results in ensuring successive supplies of water from the open tank 10 to the water boiler 12. When water reaches a predetermined level in the water boiler 12, the valve 28 is closed and the above-described cycle is repeated.

As described above, in the illustrated embodiment, the water boiler 12 comprises the heated section 34 and the hot water receiving section 36 communicating together through the pipe 38. Such construction causes a temperature of water in the heated section 34 to be different from that in the hot water receiving section 36, so that water in the heated section 34 produces a large amount of water vapor to increase pressure in the water boiler 12 or the hot water receiving section 36, resulting in hot water being supplied from the water boiler 12 through the second connection pipe 18 to the radiator 14.

Also, the first connection pipe 16 for connecting the open tank 10 and water boiler 12 together is connected to the hot water receiving section 36 and a temperature of the section 36 is lower than that of the heated section 34; thus, it takes much time until steam in the water boiler 12 reaches a superheated state. Accordingly, such construction of the water boiler 12 effectively ensures that valve 28 is opened to positively supply water from the open tank 10 to the water boiler 12 before steam therein is superheated-. Also, the hot water receiving section 36 communicates with the heated section 34. Therefore, when water flowing into the hot water receiving sectoin 36 cools water vapor in the hot water receiving section 36 into liquid, water vapor in the heated section 34 is likewise liquefied to render pressure in the section 34 negative. This causes water supplied to the section 36 to be introduced into the heated section 34, resulting in the section 34 being filled with water.

As can be seen from the foregoing, in the hot water circulating system of the present invention, the water boiler comprises the hot water receiving section and the heated section and the heated section is heated to a high temperature as compared with the hot water receiving section. Such construction causes water vapor produced in the heat section to increase pressure in the water boiler to forcibly feed hot water from the hot water receiving section to the radiator. Also, the construction causes the hot water receiving section to be kept at a relatively low temperature even when the water boiler is first empty of water. Accordingly, even when opening of the valve to be opened when the boiler is first empty is somewhat delayed for any reason, there are substantially no problems. Also, the present invention permits a rough and inexpensive check valve to be used. Use of the check valve eliminate independent arrangement of the emptiness detecting means.

Also, the present invention eliminates a necessity of heating all water in the water boiler to a high enough temperature to produce water vapor. More particularly, it is merely required to heat only water in the heated section of the water boiler to a high temperature. This results in time required for each circulating cycle being substantially reduced and the amount of circulated water per unit time being increased.

Further, the present invention permits hot water of a temperature less than 100° C., such as 50° C., to be fed from the water boiler to the radiator so that a temperature of heat discharged from the radiator may be rendered substantially uniform, resulting in comfortable heating.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A hot water circulating system comprising:

an open tank;

a water boiler arranged below said open tank and communicating with said open tank through a first connection pipe;

heating means for heating said water boiler;

a radiator in communication with said water boiler through a second connection pipe;

emptiness detecting means for detecting the substantial absence of liquid water in said water boiler; and, a valve arranged on said first connection pipe and associated with said emptiness detecting means so as to be opened to supply water from said open tank through said first connection pipe to said water boiler when said emptiness detecting means detects a substantial absence of liquid water therein;

said water boiler comprising a heated section heated by said heating means and a hot water receiving section in communication with each other;

said hot water receiving section of said water boiler being in communication with said open tank and said radiator through said first and second connection pipes;

said heated section and said hot water receiving section of said water boiler being arranged so as to cause pressure of water vapor produced in said heated section to forcibly supply hot water in said hot water receiving section to said radiator.

2. A hot water circulating system as defined in claim 1, wherein said radiator is in communication with said open tank.

3. A hot water circulating system as defined in claim 1, wherein said hot water receiving section is arranged above said heated section.

4. A hot water circulating system as defined in claim 1, wherein said emptiness detecting means comprises a temperature switch arranged on said second connection pipe and said valve comprises an on-off valve.

5. A hot water circulating system as defined in claim 1, wherein said emptiness detecting means comprises a pressure switch arranged on said first connection pipe and said valve comprises an on-off valve.

6. A hot water circulating system as defined in claim 1, wherein said valve comprises a check valve which functions also as said emptiness detecting means.

7. A hot water circulating system as defined in claim 1, wherein said open tank has a space defined therein, said space being in communication with said heating means and an ambient atmosphere so as to serve as a chamber for temporarily storing gas of a high temperature produced at said heating means.

8. A hot water circulating system comprising:

an open tank;

a water boiler arranged below said open tank and in communication with said open tank through a first connection pipe;

a radiator in communication with said water boiler and said open tank through a second connection pipe and a third connection pipe, respectively;

heating means for heating said water boiler;

emptiness detecting means for detecting the substantial absence of liquid water in said water boiler; and, a valve arranged on said first connection pipe and associated with said emptiness detecting means so as to be opened to supply water from said open tank through said first connection pipe to said water boiler when said emptiness detecting means detects a substantial absence of liquid water therein;

said water boiler comprising a heated section heated by said heating means and a hot water receiving section arranged above and in communication with said heated section;

said hot water receiving section being in communication with said open tank and said radiator through said first and second connection pipes, respectively;

said heated section and said hot water receiving section of said water boiler being arranged so as to cause pressure of water vapor produced in said heated section to forcibly supply hot water in said hot water receiving section to said radiator.

9. A hot water circulating system as defined in claim 8, wherein said hot water receiving section is arranged above said heated section.

10. A hot water circulating system as defined in claim 8, wherein said emptiness detecting means comprises a temperature switch arranged on said second connection pipe and said valve comprises an on-off valve.

11. A hot water circulating system as defined in claim 8, wherein said emptiness detecting means comprises a pressure switch arranged on said first connection pipe and said valve comprises an on-off valve.

12. A hot water circulating system as defined in claim 8, wherein said valve comprises a check valve which functions also as said emptiness detecting means.

13. A hot water circulating system as defined in claim 8, wherein said open tank has a space defined therein, said space being in communication with said heating means and an ambient atmosphere so as to serve as a chamber for temporarily storing gas of a high temperature produced at said heating means.

* * * * *